US006467555B2

(12) United States Patent
Plank et al.

(10) Patent No.: US 6,467,555 B2
(45) Date of Patent: Oct. 22, 2002

(54) PERCUSSION MECHANISM FOR AN ELECTRICAL HAND-HELD TOOL WITH A BLANK BLOW CUT-OFF

(75) Inventors: Uto Plank, Freising (DE); Martin Richter, Freising (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/055,660

(22) Filed: Jan. 23, 2002

(65) Prior Publication Data

US 2002/0108766 A1 Aug. 15, 2002

(30) Foreign Application Priority Data

Jan. 24, 2001 (DE) ..... 101 03 141

(51) Int. Cl.[7] ..... B25D 11/04
(52) U.S. Cl. ..... 173/201; 173/109; 173/212
(58) Field of Search ..... 173/201, 104, 173/109, 48, 212

(56) References Cited

U.S. PATENT DOCUMENTS 5,111,890 A * 5/1992 Ranger et al. ..... 173/210
5,873,418 A * 2/1999 Arakawa et al. ..... 173/212
6,112,830 A * 9/2000 Ziegler et al. ..... 173/109
6,116,352 A * 9/2000 Frauhammer et al. ..... 173/201
6,196,330 B1 * 3/2001 Matthias et al. ..... 173/109
6,227,309 B1 * 5/2001 Henke et al. ..... 173/201

* cited by examiner

*Primary Examiner*—Scott A. Smith
(74) *Attorney, Agent, or Firm*—Sidley Austin Brown & Wood, LLP

(57) ABSTRACT

A percussion mechanism for an electrical hand-held power tool including a guide tube, a percussion piston (4) axially displaceable in the guide tube (2), an anvil (5) for impacting a working tool and axially displaceable together with the percussion piston (4), a gas spring (1) provided on an axial side of the percussion piston (4) remote from the anvil (5), an air channel (9) for aeration of the gas spring (1) and extending between an axial region of the gas spring (1) and an axial region of the anvil (5) outwardly of the inner surface of the guide tube (2), and a ventilation opening (8) for communicating the air channel (9) with a surrounding environment and which is closed by the anvil (5) in its operational position.

6 Claims, 2 Drawing Sheets

PERCUSSION MECHANISM FOR AN ELECTRICAL HAND-HELD TOOL WITH A BLANK BLOW CUT-OFF

BACKGROUND OF THE INVENTION

1. Field of the Invention

The present invention relates to an electrical hand-held power tool, such as a hammer drill or a chisel hammer, and including a percussion mechanism with a blank blow cut-off and, in particular, to such a percussion mechanism.

2. Description of the Prior Art

Electrical hand-held power tools including a pneumatic percussion mechanism for generating blows applied to a working tool are known. The known percussion mechanism includes a guide tube, and a gas spring arranged between spaced from each other and sealingly displaceable in the guide tube, drive and percussion pistons. The percussion piston impacts and anvil that applies blows to a working tool secured in the chuck of a power tool. The application of the blows to the working tool, which is secured in the chuck with a possibility of a limited axial displacement, is interrupted in case of insufficient counter-pressure.

In a power tool described in European Publication EP 759 341 A3 for a blank blow cut-off, the gas spring is aerated into a surrounding environment through a radial ventilation opening the closing and opening of which is controlled by an axially displaceable, spring-biased ventilation control sleeve located outside of the guide tube. Thereby, an increase of the blow-producing pressure differences is prevented. The gas spring is aerated in a blank blow position of the anvil which the anvil occupies upon a return stroke as a result of an increase of the no-load run. The drawback of the solution suggested in EP 759 341 A3 consists in the use of heavily loaded oscillating components such as spring-biased ventilation sleeve. The spring force should be compensated by an additional counter-force applied by a user.

In the power tool disclosed in European Publication EP-0 438 029, an axially limited air channel is provided in the guide tube. Dependent on the position of the percussion piston, the air channel connects the impact and return impact shock absorption, providing for a non-linear system performance. In this tool, the gas spring is aerated through a radial opening in the blank blow position of the percussion piston that directly impacts the stem of the working tool. In this tool, the ventilation opening is provided in or behind the percussion piston in the region of the gas spring. The drawback of the solution suggested in EP-0 438 029 consists in that for the blank blow cut-off, a large blank or no-load run is needed which increases the weight of the percussion mechanism and dust penetration. In addition, because of the own weight of the percussion piston, the blank blow cut-off cannot be insured.

German publication DE 41 11 127 disclosed a tool in which for blank blow cut-off, the gas spring is aerated. For aerating the gas spring, radial, communicating with the surrounding environment, openings are formed in a axially displaceable drive piston formed as a hollow cylinder open at one side. The ventilation opening, which are formed in the wall of the drive piston, are connected, in a vicinity of the reverse point of the drive piston, via an annular channel formed in the guide tube, with axially extending grooves communicating with the surrounding environment. The grooves form an air channel for aerating the gas spring and the air flow in which is controlled by the ventilation openings. The ventilation openings become open only in the no-blow position of the percussion piston and aerate the gas spring. In other positions of the percussion piston, the ventilation openings are sealingly closed as a result of the surface contact of the associated surfaces of the drive piston wall and the percussion piston. Thus, the blank blow cut-off is caused directly by the no-blow position of the percussion piston. However, a reliable blank blow cut-off cannot be insured because of a one-sided pressure compensation with respect to the percussion piston and, in particular, because of temperature variations.

Accordingly, an object of the present invention is to provide a pneumatic percussion mechanism with a reduced wear of movable, heavily loaded components.

Another object of the present invention is to provide a pneumatic percussion mechanism with a reliable blank blow cut-off.

SUMMARY OF THE INVENTION

These and other objects of the present invention, which will become apparent hereinafter, are achieved by forming the air channel so that it extends from the axial region of the gas spring to the axial region of the anvil, with ventilation openings, which provide for aeration of the gas spring, being closed by the anvil when the anvil is in its operational position, and being open in the blank blow position of the anvil.

With the ventilation openings being closed or open dependent on the position of the anvil, no heavily loaded, movable components are necessary for effecting the blank blow cut-off. Thereby, the service life of these components and, thereby, of the entire percussion mechanism is increased. A reliable cut-off is insured as the pressure compensation takes place on both sides of the percussion piston.

Advantageously, the end surface of the anvil, adjacent to the percussion piston, has a flange-;like, centrally offset, annual groove region having a reduced diameter. In the non-impact position of the anvil, the groove region provides for communication of the ventilation opening with the surrounding environment via radial aeration openings. The aeration openings are formed advantageously in front of the axial region of the percussion piston.

Advantageously, a ring-shaped ventilation sleeve with a plurality of opening is provided in the guide tube between the air channel and the anvil. The ventilation sleeve determines the radial spacing between the air channel and the ventilation opening that is determined by the associated sealing outer diameter of the anvil.

Advantageously, the air channel is formed as an axially extending grooves in an outer surface of the guide tube, and it is adapted to fit in a chuck of the electrical hand-held power tool in which the percussion mechanism is used.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
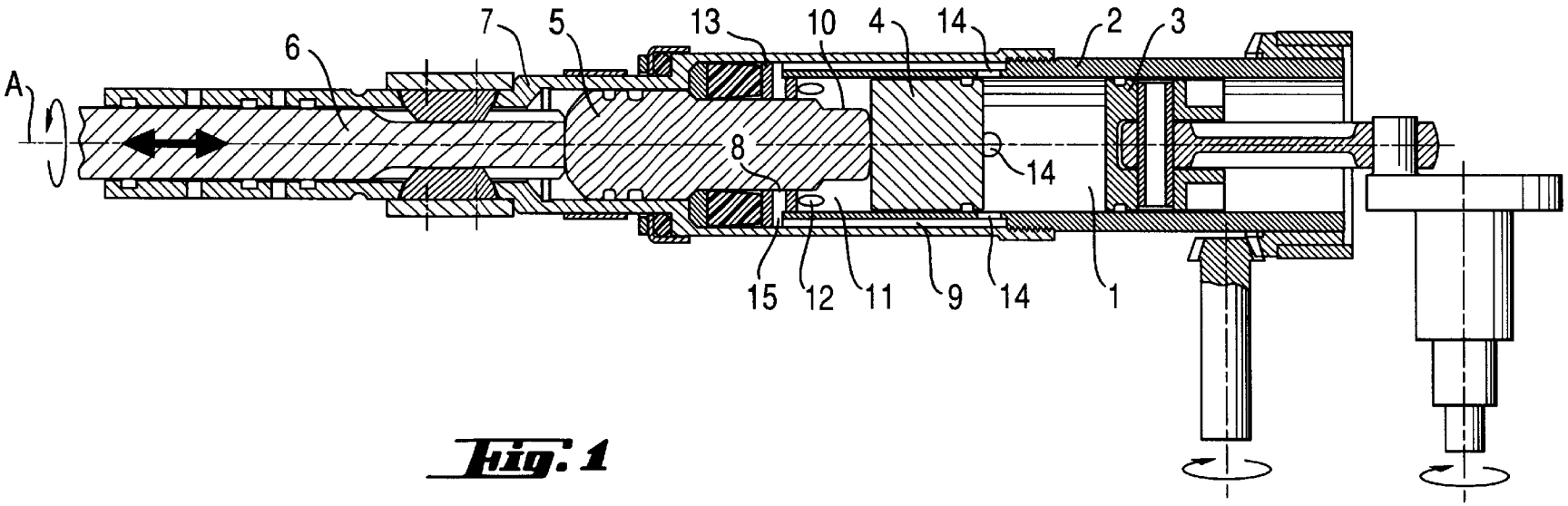
FIG. 1 shows a cross-sectional view of a pneumatic percussion mechanism according to the present invention its operational position.

A percussion mechanism according to the present invention, which is shown in the drawings, is used in an electrical hand-held power tool (not shown) and includes a gas spring 1 which is provided between a driving piston 3, which is displaced in a guide tube 2, and a percussion piston 4 which is spaced from the driving piston 3 and sealingly displaces along an axis A. The percussion piston 4 is displaced together with an anvil 5 that impacts a working tool 6 secured in a chuck 7 without a possibility of rotation relative thereto but with a possibility of a limited axial displacement relative to the chuck. An air channel 9 extends from the axial region of the gas spring 1 to the axial region of the anvil 5. The air channel 9 communicates with a ventilation opening 8 the closing and opening of which takes place upon displacement of the anvil 5. In this way, the air flow through the air channel 9 is controlled by the anvil 5. The air channel 9 is formed as a groove extending outwardly with respect to the inner surface of the guide tube 2 formed as a hollow cylinder. The air channel 9 communicates with the gas spring 1 through a radial opening 14. The ventilation opening 8 is closed by the anvil 5 when the anvil 5 is in its operational position.

Figure 2:
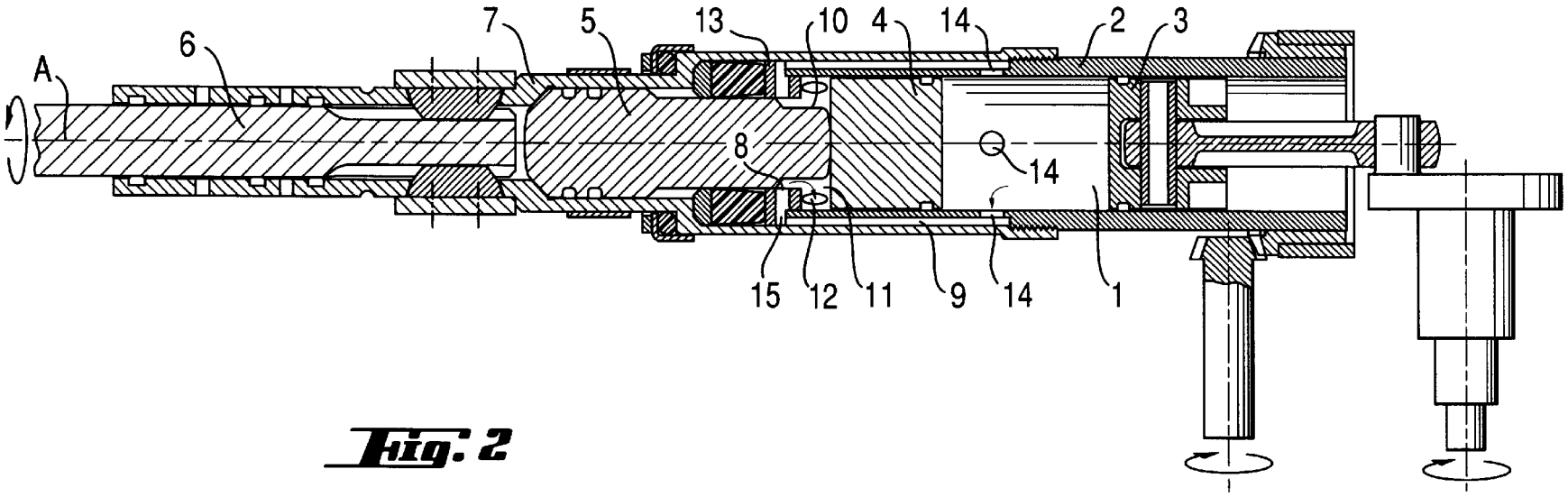
FIG. 2 shows the same view as FIG. 1 but in the blank blow position of the percussion mechanism.

As shown in FIG. 2, the ventilation opening 8 is open in the non-impact position of the anvil 5, so that the gas spring 1 is aerated. The end surface of the anvil 5, adjacent to the percussion piston 4, has a flange-like, centrally offset, annual groove region 10 having a reduced diameter. In the non-impact position of the anvil 5, the groove region 10 provides for communication of the ventilation opening 8 with the surrounding environment via radial aeration openings 12. The aeration openings 12 are formed in front of the axial region of the percussion piston 4.

Within the guide pipe 2, between the air channel 9 and the anvil 5, a ring-shaped ventilation sleeve 13 with a plurality of opening 15 is provided. The ventilation sleeve 13 determines the radial spacing between the air channel 9 and the ventilation opening 8 that is determined by the associated sealing outer diameter of the anvil 5.

Though the present invention was shown and described with references to the preferred embodiment, such are merely illustrative of the present invention and are not to be construed as a limitation thereof, and various modifications to the present invention will be apparent to those skilled in the art. It is, therefore, not intended that the present invention be limited to the disclosed embodiment or details thereof, and the present invention includes all of variations and/or alternative embodiments within the spirit and scope of the present invention as defined by the appended claims.

What is claimed is:

1. A percussion mechanism for an electrical hand-held power tool, comprising a guide tube (2); a percussion piston (4) axially displaceable in the guide tube (2); and anvil (5) for impacting a working tool and axially displaceable together with the percussion piston (4); a gas spring (1) provided on an axial side of the percussion piston (4) remote from the anvil (5); an air channel (9) for aeration of the gas spring (1) and extending between an axial region of the gas spring (1) and an axial region of the anvil (5) outwardly of an inner surface of the guide tube (2); and a ventilation opening (8) for communicating the air channel (9) with a surrounding environment, the ventilation opening (8) being closed by the anvil (5) in an operational position of the anvil (5).

2. A percussion mechanism according to claim 1, wherein the anvil (5) has, at an end side thereof adjacent to the percussion piston (4), reduced diameter, annular groove region (10) that provides for communication of the air channel (9) with the surrounding environment through the ventilation opening (8) by freeing the ventilation opening (8) which communicates with the environment via at least one aeration opening (12).

3. A percussion mechanism according to claim 2, further comprising an annular ventilation sleeve (13) located between the air channel (9) and the anvil (5) and having a plurality of radial openings (15) that communicate the ventilation opening (8) with the air channel (9).

4. A percussion mechanism according to claim 2, wherein the aeration opening (12) is located in front of axial region of the percussion piston (4).

5. A percussion mechanism according to claim 1, wherein the guide tube (2) is formed as a hollow cylinder.

6. A percussion mechanism according to claim 1, wherein the air channel (9) is formed as an axially extending groove in an outer surface of the guide tube (2) and adapted to fit in a chuck (7) of the electrical hand-held power tool in which the percussion mechanism is used.

* * * * *